US009773631B2

(12) United States Patent
Ishizaki

(10) Patent No.: US 9,773,631 B2
(45) Date of Patent: Sep. 26, 2017

(54) POWER CIRCUIT INTERRUPTING DEVICE

(75) Inventor: Shin Ishizaki, Hadano (JP)

(73) Assignee: NISSAN MOTOR CO., LTD., Yokohama-shi (JP)

( * ) Notice: Subject to any disclaimer, the term of this patent is extended or adjusted under 35 U.S.C. 154(b) by 396 days.

(21) Appl. No.: 13/988,686

(22) PCT Filed: Oct. 5, 2011

(86) PCT No.: PCT/JP2011/072982

§ 371 (c)(1),
(2), (4) Date: May 21, 2013

(87) PCT Pub. No.: WO2012/070318

PCT Pub. Date: May 31, 2012

(65) Prior Publication Data

US 2013/0241687 A1 Sep. 19, 2013

(30) Foreign Application Priority Data

Nov. 23, 2010 (JP) ..... 2010-260694

(51) Int. Cl.
*H01H 85/02* (2006.01)
*H01H 9/08* (2006.01)
(Continued)

(52) U.S. Cl.
CPC ..... *H01H 85/0241* (2013.01); *H01H 9/085* (2013.01); *H01H 9/10* (2013.01); *H01H 9/102* (2013.01); *H01H 2085/206* (2013.01)

(58) Field of Classification Search
CPC ..... H01H 9/085; H01H 85/0241; H01H 2085/206; H01H 2085/2065; H01H 2085/207; H01H 9/10; H01H 9/102
(Continued)

(56) References Cited

U.S. PATENT DOCUMENTS 4,067,103 A * 1/1978 Ciesmier ..... 29/623
4,344,060 A * 8/1982 Ciesemier ..... H01H 85/0417 29/623

(Continued)

FOREIGN PATENT DOCUMENTS

CN 1164112 A 11/1997
DE 297 21 446 U1 4/1998

(Continued)

OTHER PUBLICATIONS

Russian Decision on Grant and English language translation dated Jul. 10, 2014, 12 pgs.

(Continued)

*Primary Examiner* — Anatoly Vortman
*Assistant Examiner* — Jacob Crum
(74) *Attorney, Agent, or Firm* — Foley & Lardner LLP

(57) ABSTRACT

A power circuit interrupting device including a first housing including a pair of fixed electrodes and a fuse having terminals at both ends thereof, and a second housing including a moveable electrode, the moveable electrode interrupting electrical connection between the fixed electrodes when the second housing is uncoupled from the first housing, and establishing the electrical connection between the fixed electrodes when the second housing is coupled with the first housing. The first housing has an opening provided for carrying out a continuity test for the fuse. The opening is always covered with the second housing in a condition that continuity of a circuit is allowed. The power circuit interrupting device serves to facilitate the continuity test for the fuse built therein and comply with such a maintenance procedure that the continuity test should be carried out after interrupting continuity of the power circuit.

8 Claims, 4 Drawing Sheets

(51) Int. Cl.
*H01H 9/10* (2006.01)
*H01H 85/20* (2006.01)

(58) Field of Classification Search
USPC ..... 337/187, 194, 196; 361/640, 642, 646, 361/824, 835; 200/16 E, 561
See application file for complete search history.

(56) References Cited

U.S. PATENT DOCUMENTS

| | | | | |
|---|---|---|---|---|
| 5,831,228 | A | 11/1998 | Kuki et al. | |
| 5,842,560 | A | 12/1998 | Kuki et al. | |
| 5,847,338 | A | 12/1998 | Kuki et al. | |
| 5,859,580 | A | 1/1999 | Hashizawa et al. | |
| 6,054,915 | A * | 4/2000 | Rowton et al. | 337/216 |
| 6,101,079 | A * | 8/2000 | Viklund | 361/119 |
| 6,157,287 | A * | 12/2000 | Douglass et al. | 337/198 |
| 6,407,656 | B1 | 6/2002 | Konda et al. | |
| 6,459,354 | B2 | 10/2002 | Konda et al. | |
| 6,459,558 | B1 | 10/2002 | Hashizawa et al. | |
| 7,948,353 | B2 | 5/2011 | Deno et al. | |
| 2005/0098419 | A1 * | 5/2005 | Matsui et al. | 200/311 |
| 2010/0245025 | A1 * | 9/2010 | de Leon et al. | 337/290 |

FOREIGN PATENT DOCUMENTS

| | | | |
|---|---|---|---|
| EP | 0 790 677 | A2 | 8/1997 |
| JP | 5-55721 | U | 7/1993 |
| JP | 9-265874 | A | 10/1997 |
| JP | 10-83753 | A | 3/1998 |
| JP | 2000-251611 | A | 9/2000 |
| JP | 2001-126592 | A | 5/2001 |
| JP | 2009-37778 | A | 2/2009 |
| RU | 90 276 | U1 | 12/2009 |

OTHER PUBLICATIONS

Chinese Office Action dated Nov. 26, 2014, 6 pgs.
Korean Office Action dated Mar. 18, 2014 (4 pgs.).

* cited by examiner

POWER CIRCUIT INTERRUPTING DEVICE

TECHNICAL FIELD

The present invention relates to a power circuit interrupting device that electrically connects and disconnects a power circuit of a hybrid motor vehicle, an electric motor vehicle, etc.

BACKGROUND ART

Upon carrying out a maintenance work of a hybrid motor vehicle, an electric motor vehicle, etc., a power circuit must be brought into interruption by a manual operation in order to ensure safe of a maintenance worker. Such a power circuit interrupting device as described in the following Patent Literature 1 is known.

The device as described in Patent Literature 1 includes a pair of fixed electrodes and a fuse which are disposed in a casing, a moveable electrode capable of being coupled to the fixed electrodes to establish electrical connection between the fixed electrodes and being uncoupled from the fixed electrodes to interrupt the electrical connection therebetween, and a coupling/uncoupling operation handle provided with the moveable electrode. The device is constructed such that a conduction path is accommodated within the casing when an electrical continuity is established, and therefore, the device is excellent in view of safety.

However, in the device described in the Patent Literature 1, the fuse is disposed within the casing. Due to this construction, in order to carry out a continuity test for the fuse, it is necessary to uncouple the moveable electrode from the fixed electrodes, loosen screws, and open the casing to thereby expose the fuse outside. Accordingly, it takes a long time for performing the test procedure.

CITATION LIST

Patent Literrature

Patent Literature 1: Japanese Patent Application Unexamined Publication No. 9-265874

SUMMARY OF INVENTION

A power circuit interrupting device according the present invention includes a first housing including a pair of fixed electrodes and a fuse, and a second housing including a moveable electrode, the moveable electrode interrupting electrical connection between the fixed electrodes when the second housing is uncoupled from the first housing, and establishing the electrical connection between the fixed electrodes when the second housing is coupled with the first housing. The first housing has an opening provided for carrying out a continuity test for the fuse. The opening is covered with the second housing in a condition that continuity of a circuit is allowed.

In the device according to the present invention, it is possible to carry out a continuity test for the fuse without exposing a whole portion of the fuse. Therefore, the device can serve to reduce a time for performing the test procedure. Further, in order to carry out the continuity test, the second housing having the moveable electrode must be uncoupled from the first housing, whereby the device can serve to keep safety. In addition, since the opening for the continuity test is covered with the second housing in a normal condition in which continuity of the power circuit is allowed, a foreign material such as dust can be prevented from entering into the device.

DESCRIPTION OF EMBODIMENTS

In the following, an embodiment of the present invention is explained by referring to FIG. 1 to FIG. 8(*b*).

Figure 1:
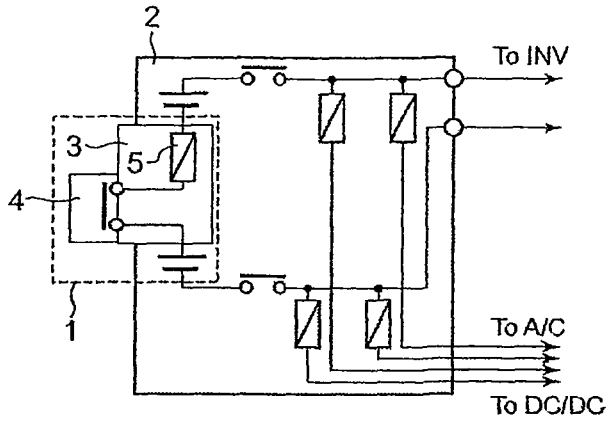
FIG. 1 is a circuit diagram showing a part of a power circuit including a power circuit interrupting device (SDSW) according to an embodiment of the present invention.

FIG. 1 is an electric circuit diagram showing a part of a power circuit of a hybrid vehicle, an electric vehicle, etc. Service disconnect switch (hereinafter referred to as simply "SDSW") 1 is a power circuit interrupting device according to the present invention. SDSW 1 serves as a breaker device that constitutes a part of battery pack 2 and is disposed in a power circuit to interrupt or establish electrical connection between batteries, and can interrupt continuity of the power circuit including a fuse.

SDSW 1 includes first housing 3 including a pair of fixed electrodes and fuse 5, and second housing 4 including a moveable electrode that is uncoupled from the fixed electrodes to disconnect the fixed electrodes from each other or coupled with the fixed electrodes to connect the fixed electrodes with each other. A work of a continuity test can be safely performed by interrupting the electrical connection between batteries by uncoupling the moveable electrode from the fixed electrodes through second housing 4 or establishing the electrical connection between batteries by coupling the moveable electrode with the fixed electrodes through second housing 4.

In a condition that continuity of the circuit is allowed, electric current from the batteries flows to an inverter and a DC/DC converter through a main relay.

Figure 2:
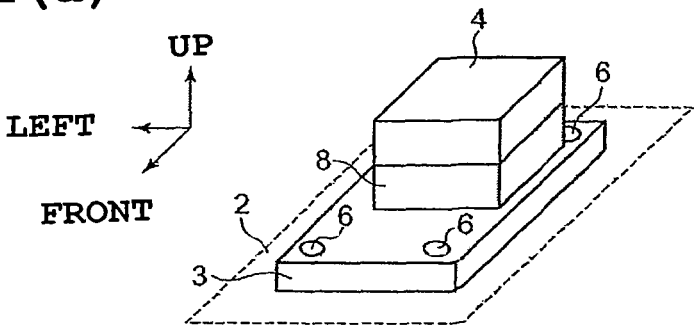
FIG. 2(*a*) is a perspective view of a whole construction of the SDSW according to the embodiment, and FIG. 2(*b*) is a front view thereof.
Figure 2:
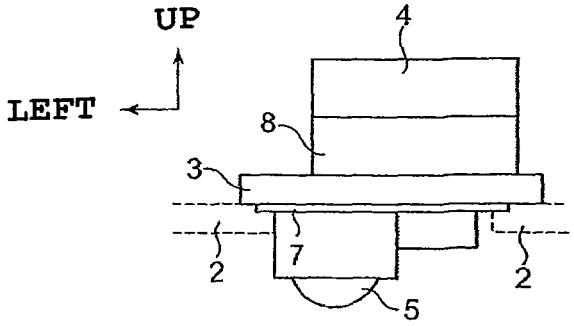

FIG. 2(*a*) is a perspective view of SDSW 1 as a whole according to the embodiment. SDSW 1 is fixed to battery pack 2 through bolts inserted into bolt holes 6 which are formed at four corners of first housing 3. Thus, SDSW 1 is formed integrally with battery pack 2, and configured to a box shape. In SDSW 1, when second housing 4 is coupled to peripheral wall portion 8 that projects outwardly from a base portion of first housing 3, the electrodes of first housing 3 and the electrode of second housing 4 are connected with each other to thereby allow continuity of the power circuit.

FIG. 2(*b*) is a front view of SDSW 1 as viewed from a forward direction. Seal 7 is provided in a connecting portion between SDSW 1 and battery pack 2, and prevents a foreign material such as dust, water, etc. from entering into battery pack 2. Fuse 5 is arranged within a box-shaped space formed by SDSW 1 and battery pack 2.

Figure 3A:
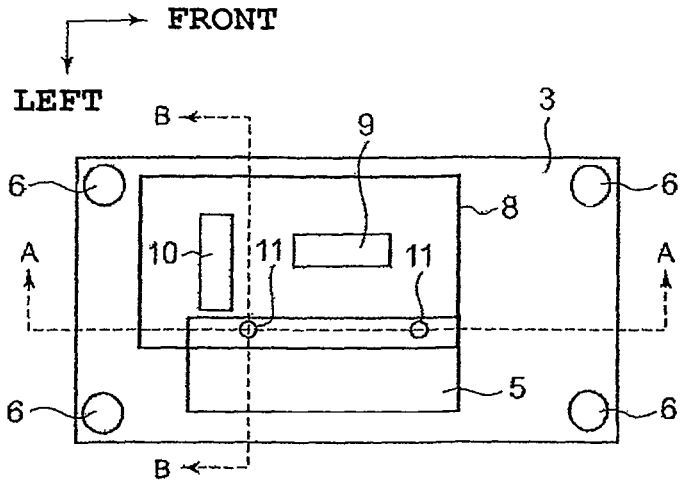
FIG. 3(*a*) is a plan view of a first housing according to the embodiment, and FIG. 3(*b*) is an explanatory diagram showing arrangement of a fuse and fixed electrodes within the first housing.
Figure 3B:
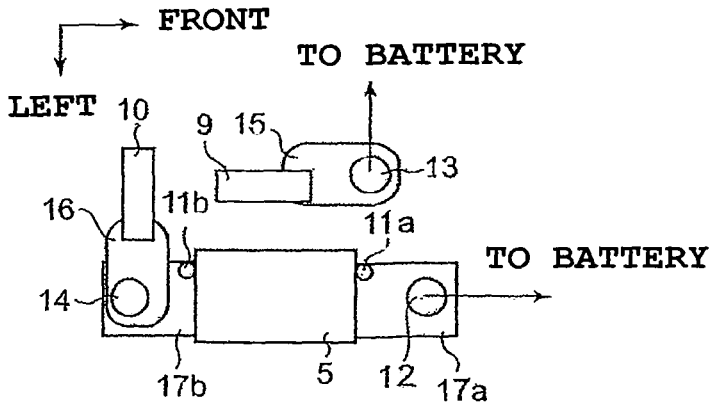

FIG. 3(*a*) is a plan view of first housing 3 according to the embodiment as viewed from an upper side. In a condition that continuity of the power circuit is allowed, an inside of peripheral wall portion 8 is covered with second housing 4. Disposed on the inside of peripheral wall portion 8 are a pair of fixed electrodes 9, 10 and openings 11 (11*a*, 11*b*) for a continuity test of fuse 5 that has terminals at both ends thereof. The continuity test is carried out by inserting probes into openings 11 and contacting the probes with conductive portions at the both ends of fuse 5. That is, the continuity test can be carried out without removing SDSW 1 from battery pack 2 to thereby expose a whole portion of the fuse outside. Accordingly, a time for performing the test procedure can be reduced.

If openings 11 are disposed on an outside of peripheral wall portion 8, the continuity test can be carried out even in the condition that continuity of the power circuit is allowed. Therefore, safety of a worker of the continuity test can be not always ensured. In this embodiment, since openings 11 cannot be exposed outside unless second housing 4 is detached, it is possible to surely comply with such a maintenance procedure that the continuity test is carried out after continuity of the power circuit must be interrupted.

Further, since openings 11 are covered with second housing 4 in the condition that continuity of the power circuit is allowed, entrance of a foreign material such as dust, etc. into battery pack 2 can be prevented even though a dedicated cover is not provided for openings 11.

As shown in FIG. 3(*a*), at least a part of fuse 5 is arranged in a plane of projection on which peripheral wall portion 8 is projected in an uncoupling/coupling direction of second housing 4. With this arrangement, fuse 5 is located in a position close to fixed electrode 9, so that first housing 3 can be reduced in size. Further, the continuity test is conducted by inserting probes into openings 11 and contacting the probes to conductive portions at both ends of fuse 5. For this reason, it is necessary to arranged openings 11 and fuse 5 close to each other. Therefore, openings 11 are also arranged close to fixed electrode. As a result, peripheral wall portion 8 can be reduced in size, and therefore, second housing 4 also can be reduced in size.

FIG. 3(*b*) is a diagram showing arrangement of the pair of fixed electrodes 9, 10 and fuse 5 within first housing 3 according to this embodiment. Fuse terminal 17*a* of fuse 5 is connected with a wire through bolt 12, and then connected with a forward battery. One fixed electrode terminal 9 is connected with a wire through conductor 15 and bolt 13, and then connected with a rightward battery. The other fixed electrode terminal 10 is connected with fuse terminal 17*b* through conductor 16 and bolt 14. Accordingly, the continuity test can be carried out by using fixed electrode terminal 10 and opening 11*a*. However, since fixed electrode terminal 9 and fixed electrode terminal 10 are not distinguishable in appearance from each other, there is a possibility of carrying out an erroneous test using fixed electrode terminal 9 and opening 11*a*. In order to solve this problem, in this embodiment, opening 11*b*for the continuity test is further provided so as to prevent fixed electrode terminals 9, 10 from being used in the continuity test. As a result, it is possible to surely prevent the erroneous test.

Figure 4:
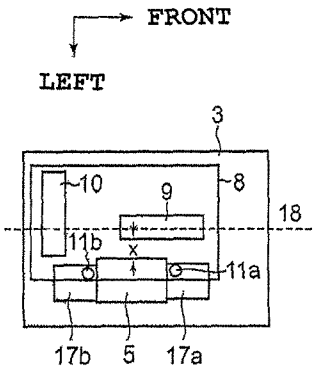
FIGS. 4(*a*)-4(*c*) are explanatory diagrams showing examples of arrangement of a pair of fixed electrodes and a fuse within the first housing.
Figure 4:
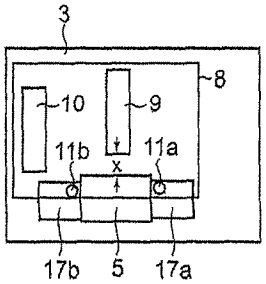
Figure 4:
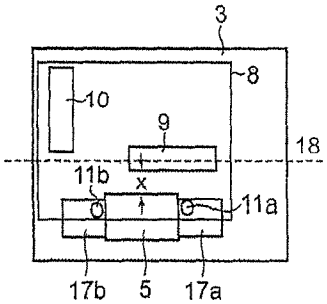

FIGS. 4(*a*)-4(*c*) are diagrams for comparison between an area of first housing 3 and an area of peripheral wall portion 8 in arrangement of the pair of fixed electrodes 9, 10 and fuse 5 in first housing 3.

In a case where fixed electrodes each having an elongated shape are used, the present invention may be embodied as shown in FIGS. 4(*b*) and 4(*c*). In contrast, in the above-described embodiment, as shown in FIG. 4(*a*), the one fixed electrode 9 is arranged in parallel to fuse 5. The other fixed electrode 10 is arranged to extend in the direction in which makes an angle of 90 degrees with respect to a longitudinal direction of fixed electrode 9, and is arranged to intersect with extension line 18 of the longitudinal direction of fixed electrode 9. With this arrangement, as compared to the arrangement as shown in FIGS. 4(*b*) and 4(*c*), even though a distance x between fuse 5 and the one fixed electrode 9 is same, the pair of fixed electrodes 9, 10 and fuse 5 can be arranged in a minimum area, thereby reducing the size of first housing 3. Further, since the continuity test is carried out by inserting probes into openings 11 and contacting the probes with the conductive portions at both ends of fuse 5, openings 11 and fuse 5 must be located close to each other so that the pair of fixed electrodes 9, 10 and openings 11 can be arranged in a minimum area. Accordingly, it is possible to reduce not only peripheral wall portion 8 but also second housing 4 in size.

Figure 5:
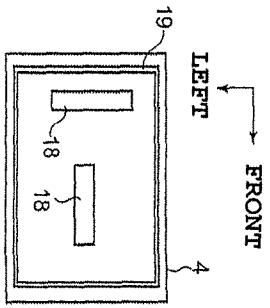
FIG. 5 is a bottom view of a second housing according to the embodiment.

FIG. 5 is a bottom view of second housing 4 according to this embodiment when viewed from an underside thereof. Disposed within second housing 4 are moveable electrodes 18 that have shapes corresponding to those of the pair of fixed electrodes 9, 10 of first housing 3. Second housing 4 includes seal 19 extending along a periphery of second housing 4 which is fitted to first housing 3 when second housing 4 is inserted into first housing 3. Seal 19 seals a clearance between peripheral wall portion 8 of first housing 3 and the periphery of second housing 4. Accordingly, in the condition that continuity of the power circuit is allowed, the pair of fixed electrodes 9, 10 provided in first housing 3 can be made water-proof, and at the same time, openings 11 for the continuity test also can be made water-proof. Accordingly, it is not necessary to take an individual water-proof measure.

Figure 6:
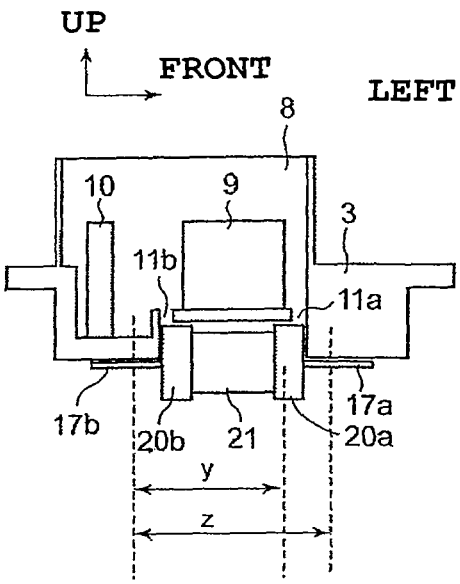
FIG. 6(*a*) is a sectional view as viewed from a left side of the SDSW according to the embodiment, and FIG. 6(*b*) is a sectional view as viewed from a front side of the SDSW according to the embodiment.
Figure 6:
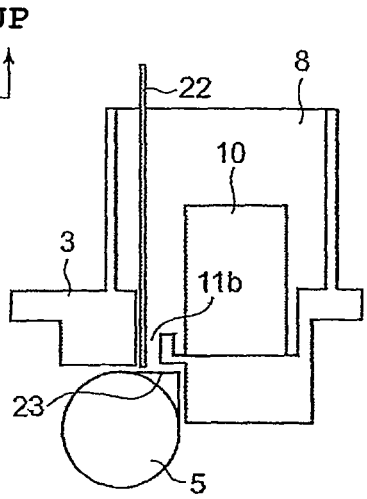
Figure 7:
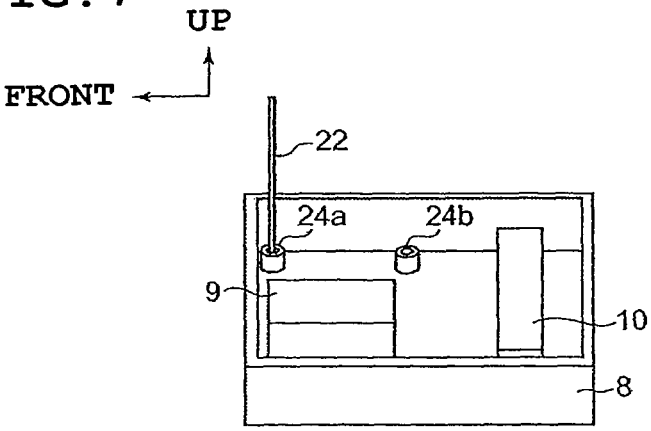
FIG. 7 is a perspective view showing bosses disposed along a periphery of an opening of the first housing.

FIG. 6(*a*) is a sectional view of first housing 3, taken along lines A-A show in FIG. 3(*a*). Fuse terminals 17*a*, 17*b* at both ends of the fuse element are connected with a battery harness, etc. and form a circuit. Fuse caps 20*a*, 20*b* are parts for sealing the fuse element and an arc-extinguishing material in cylindrical fuse cover 21.

In this embodiment, fuse cap 20*a* on the side of fuse terminal 17*a* serves as a conductor as a whole including an outer surface thereof. The continuity test is carried out by contacting probe 22 inserted through opening 11*a* with fuse cap 20*a*. When not fuse terminal 17*a* but fuse cap 20*a* is thus utilized in the continuity test, a distance y between fuse cap 20*a*and fuse terminal 17*b* electrically connected to fixed electrode terminal 10 is shorter than a distance z between fuse terminal 17*a* and fuse terminal 17*b* electrically connected to fixed electrode terminal 10. Therefore, it is possible to locate opening 11*a* closer to fixed electrode 10. Accordingly, peripheral wall portion 8 can be reduced in size, and therefore, second housing 4 can be reduced in size.

Further, in a case where only one fuse cap 20*a* of the pair of fuse caps 20*a*, 20*b*is formed as a conductor, there is a possibility that fuse 5 is connected in a reverse direction upon assembling the apparatus and thereby the continuity test cannot be carried out. To avoid such a problem, in this embodiment, fuse cap 20*b* on the side of fuse terminal 17*b* is also formed as a conductor, and opening 11*b* associated with fuse cap 20*b* is provided.

FIG. 6(*b*) is a sectional view of first housing 3, taken along line B-B shown in FIG. 3(*a*). Fuse 5 is located close to fixed electrode terminals 9, 10 as described above, so that openings 11*a*, 11*b* for the continuity test can be formed above fuse caps 20*a*, 20*b* in an opposed relation to fuse caps 20*a*, 20*b*. With this construction, the continuity test can be carried out only by inserting probes 22 into openings 11*a*, 11*b* such that probes 22 are placed in an upright position.

As a result, it is possible to carry out the continuity test in a stable condition.

As shown in FIG. 6(*b*), it is desirable to form continuity test surface 23 of each of fuse caps 20*a*, 20*b* which is contacted with probe 22, as a plane surface. By thus forming continuity test surface 23 as a plane surface, probe 22 for the continuity test can be prevented from slipping on continuity test surface 23 so that the continuity test can be carried out in a more stable condition.

Although in the above-described embodiment, the procedure of carrying out the continuity test in such a state that second housing 4 is detached to expose fixed electrode terminals 9, 10, is explained, dedicated cap 25 capable of being inserted into peripheral wall portion 8 after detaching second housing 4 may be used in order to completely prohibit use of fixed electrode terminals 9, 10 for the continuity test.

Figure 8:
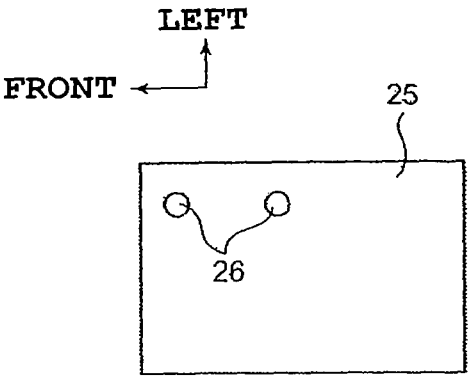
FIG. 8(*a*) is a plan view of a dedicated cap for a continuity test, and FIG. 8(*b*) is a sectional view of the dedicated cap as viewed from a left side thereof.
Figure 8:
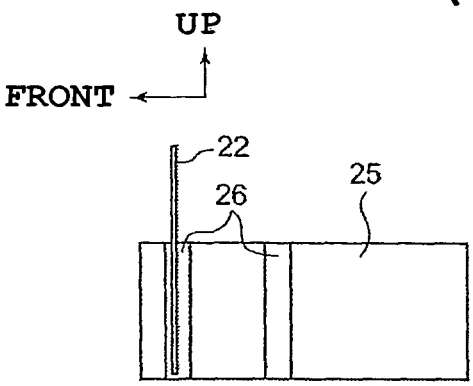

FIG. 8(*a*) is a plan view of dedicated cap 25 to be mounted to peripheral wall portion 8, when viewed from an upper side of dedicated cap 25. FIG. 8(*b*) is a sectional view of dedicated cap 25 when viewed from a lateral side thereof. A pair of holes 26 for the continuity test are formed in dedicated cap 25 corresponding to the pair of openings 11 for the continuity test. In such a state that dedicated cap 25 is coupled to peripheral wall portion 8, fixed electrode terminals 9, 10 are covered with dedicated cap 25, and only holes 26 are exposed, so that fixed electrode terminals 9, 10 cannot be used in the continuity test. Further, holes 26 in dedicated cap 25 each serve as a guide that guides probe 22 for the continuity test. Therefore, probes 22 can be raised at a predetermined angle relative to the continuity test surface so that the continuity test can be carried out in a stable condition.

Further, although in the above-described embodiment, seal 19 is provided in second housing 4, seal 19 may be provided on the side of peripheral wall portion 8. Even in such a case, same effects as those in the above-described embodiment can be obtained.

In addition, in a case where SDSW 1 is arranged in a position in which SDSW 1 is prevented from contacting with water, the seal can be omitted. Further, peripheral wall portion 8 can be provided with a vent hole that has such a size as to prevent insertion of probe 22.

The invention claimed is:

1. A power circuit interrupting device comprising:

a first housing having a peripheral wall portion and including a pair of fixed electrodes and a fuse, the fuse having at both ends thereof conductive portions; and a second housing including a moveable electrode, the moveable electrode interrupting electrical connection between the fixed electrodes when the second housing is uncoupled from the first housing, and establishing the electrical connection between the fixed electrodes when the second housing is coupled with the first housing, wherein the first housing has two openings formed on a surface on the inside of the peripheral wall portion and corresponding to the conductive portions of the fuse for carrying out a continuity test for the fuse such that probes can be inserted into the two openings of the first housing and directly contact with the conductive portions of the fuse, the two openings being covered with the second housing in a condition that continuity of a circuit is allowed, and wherein coupling the second housing with the first housing causes (1) the fixed electrodes of the first housing to be electrically connected and (2) the two openings of the first housing to be covered with the second housing, at the same time, and uncoupling the second housing from the first housing causes (1) the fixed electrodes of the first housing to be electrically disconnected and (2) the two openings of the first housing to be exposed, at the same time.

2. The power circuit interrupting device as claimed in claim 1, wherein at least a part of the fuse is arranged in a plane of projection on which an area covered with the second housing is projected in an uncoupling/coupling direction of the second housing.

3. The power circuit interrupting device as claimed in claim 1, wherein the fuse comprises fuse terminals disposed at both ends of the fuse, a fuse cover, and fuse caps each having a surface electrically connected with the fuse terminals, the fuse caps being disposed on both end portions of the fuse cover.

4. The power circuit interrupting device as claimed in claim 1, wherein the fuse comprises fuse terminals disposed at both ends of the fuse, and the fixed electrodes are constituted of a pair of elongated terminals, one of the pair of fixed electrode terminals being arranged parallel to the fuse, the other of the pair of fixed electrode terminals being arranged to intersect with an extension line of the one of the pair of fixed electrode terminals.

5. The power circuit interrupting device as claimed in claim 3, wherein the fuse cap has a plane surface portion opposed to one of the two openings for the continuity test.

6. The power circuit interrupting device as claimed in claim 1, wherein the two openings are formed corresponding to a pair of continuity test portions of the fuse.

7. The power circuit interrupting device as claimed in claim 1, wherein a periphery of the two openings is raised.

8. The power circuit interrupting device as claimed in claim 1, wherein the second housing is selectively uncoupled from the first housing such that the continuity test for the fuse can be carried out only when the second housing is uncoupled from the first housing.

* * * * *